United States Patent [19]

Engquist et al.

[11] Patent Number: 4,612,767

[45] Date of Patent: Sep. 23, 1986

[54] EXHAUST MANIFOLD SHIELD

[75] Inventors: Karl R. Engquist, Peoria; Keith K. Klintworth, Dunlap, both of Ill.

[73] Assignee: Caterpillar Inc., Peoria, Ill.

[21] Appl. No.: 707,301

[22] Filed: Mar. 1, 1985

[51] Int. Cl.[4] ..... F01N 7/10

[52] U.S. Cl. ..... 60/321; 60/323

[58] Field of Search ..... 60/320, 321, 323; 123/41.56, 41.6

[56] References Cited

U.S. PATENT DOCUMENTS

| | | | |
|---|---|---|---|
| 3,237,716 | 3/1966 | Parsons | 181/72 |
| 3,491,849 | 1/1970 | Newkirk | 181/33 |
| 3,850,152 | 11/1974 | Hollins | 123/122 H |
| 3,863,445 | 2/1975 | Heath | 60/299 |

FOREIGN PATENT DOCUMENTS

| | | | |
|---|---|---|---|
| 3238330 | 4/1984 | Fed. Rep. of Germany | 60/323 |
| 244806 | 10/1969 | U.S.S.R. | 60/323 |

*Primary Examiner*—Douglas Hart

*Attorney, Agent, or Firm*—Larry G. Cain

[57] ABSTRACT

Heat shield assemblies are normally connected to engines which have exhaust systems in order to reduce the temperature of the outer surface. The skin temperature of the outer surface of the heat shield assembly must be cooled so that persons coming in contact with such a surface is not burned. The subject heat shield assembly includes a heat source, an inner member and an outer member which respectively define first and second cooling flow paths. The first cooling flow path being adapted to convect heat away from the heat source and the inner member as air passes therethrough and the second cooling flow path being adapted to convect heat away from the inner member and the outer member as air passes therethrough. The air passing through the first and second cooling flow paths effectively reduces the temperature of the outer member so that no one would be burned upon contact therewith.

15 Claims, 4 Drawing Figures

EXHAUST MANIFOLD SHIELD

1. Technical Field

This invention relates generally to engines and more particularly to exhaust manifold shields.

2. Background of the Invention

Since the exhaust from an engine is extremely hot, the use of shielding on exhaust systems has long been used in an attempt to protect humans from becoming burned when contacting the exhaust systems. When engines are used as stationary power supplies, such as generator sets or pumping stations, the necessity of heat shields has become essential. For example, when engines are located on both sides of a walkway, a maintenance person in performing his normal duties could, if not careful, come in contact with the exhaust manifold of one of the engines.

The main objective of using shields is to provide a member that has a low skin temperature so that a person contacting the member will not be burned. For example, U.S. Pat. No. 3,237,716 issued Mar. 1, 1966 to B. D. Parsons, U.S. Pat. No. 3,850,152 issued Nov. 26, 1974 to Jesse R. Hollins, and U.S. Pat. No. 3,863,445 issued Feb. 4, 1975 to Robert A. Heath all disclose heat shields. All of these patents disclose a single wrapper which provides a space between the exhaust system and the shield. U.S. Pat. No. 3,491,849 issued Jan. 27, 1970 to J. D. Newkirk discloses a shield having an inner trapped air space, a spring biasing means, an insulating material and a piece of sheet metal spaced around the exhaust system. The shields as described above have either failed to reduce the outer skin temperature to an acceptable temperature or are so costly to manufacture that users refuse to invest capital for such shields.

The present invention is directed to overcoming one or more of the problems as set forth above.

DISCLOSURE OF THE INVENTION

In one aspect of the present invention, a heat shield assembly is disclosed and is adapted for use with an exhaust system of an engine. The heat shield assembly comprises a heat source connected to the engine, an inner member partially surrounding the heat source and being supported in a predetermined spaced relation to the heat source. A first cooling flow path is defined between the heat source and the inner member and is adapted to convect heat from the heat source and the inner member. The heat shield assembly also includes an outer member having an upper portion and a lower portion that is supported in at least partially covering predetermined space relation to the inner member. A second cooling flow path is defined between the inner member and the outer member and is adapted to convect heat from the inner and outer members.

The present invention provides a heat shield assembly that reduces the outer skin temperature to an acceptable temperature and is economical to manufacture. The inner member partially surrounds the heat source and is supported in a predetermined spaced relation from the heat source. The outer member is supported in at least a partially covering predetermined spaced relation to the inner member and effectively reduces the skin temperature of the outer member to an acceptable temperature. The first cooling flow path and the second cooling flow path carry heat away from the inner and outer member.

BEST MODE FOR CARRYING OUT THE INVENTION

Figure 1:
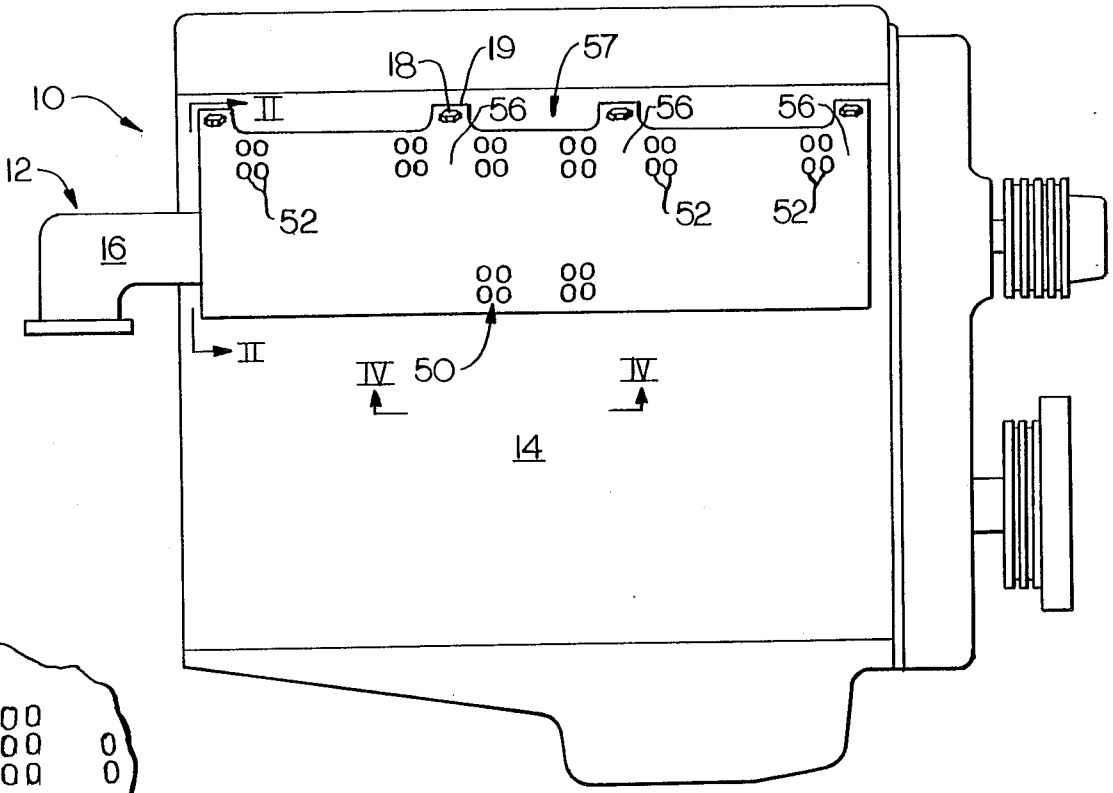
FIG. 1 is a diagrammatic representation of a side view of an engine with the heat shield assembly connected to the engine.

Referring now to the drawings and more specifically to FIG. 1, a heat shield assembly 10 is shown for use with an exhaust system 12 of an engine 14. As more clearly illustrated in FIG. 2, a heat source, such as a typically horizontal exhaust manifold 16, is connected to the engine 14 and the heat shield assembly 10 partially surrounds the exhaust manifold 16. The heat shield assembly 10 is connected to the engine 14 with a plurality of fasteners 18, tabs 19 and a plurality of spacers 20.

The heat shield assembly 10 includes an inner member 22 partially surrounding the exhaust manifold 16 and is supported in a predetermined spaced relation thereto. In the embodiment shown, the inner member 22 is a solid member, but it could have a limited number of perforations therein. The inner member 22 has a bottom portion 24 spaced from the exhaust manifold 16 to form a lower inlet opening 26 that defines a first cross-sectional area 28. A top portion 30 of the inner member 22 is spaced from the exhaust manifold 16 a distance greater than that of the bottom portion 24 to form an upper outlet opening 32 which defines a second cross-sectional area 34 which is larger than the first cross-sectional area 28. An intermediate portion 36 of the inner member 22 is located between the top portion 30 and the bottom portion 24 and is spaced away from the exhaust manifold 16 a distance intermediate the distances at the bottom portion 24 and the top portion 30.

A first cooling flow path 38 is defined in the heat shield assembly 10 between the exhaust manifold 16 and the inner member 22 and as represented by arrows "A", is adapted to pass air therethrough to effectively convect heat away from the exhaust manifold 16 and the inner member 22.

The heat shield assembly 10 also includes an outer member 42 having an upper portion 44, a lower portion 46, and an intermediate portion 48 located therebetween. The outer member 42 is supported in at least a partially covering predetermined spaced relation to the inner member 22. The lower portion 46 is directly connected with the inner member 22 and the upper portion 44 is spaced from the inner member 22 at a predetermined distance. The intermediate portion 48 is spaced from the inner member 22 at a distance less than the predetermined distance between the upper portion 46 and the inner member 22.

Figure 4:
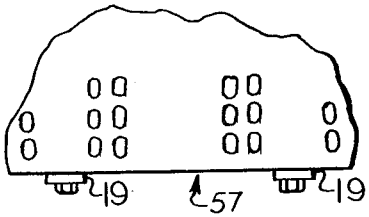
FIG. 4 is a partial side view takenalong line IV—IV in FIG. 1.
Figure 3:
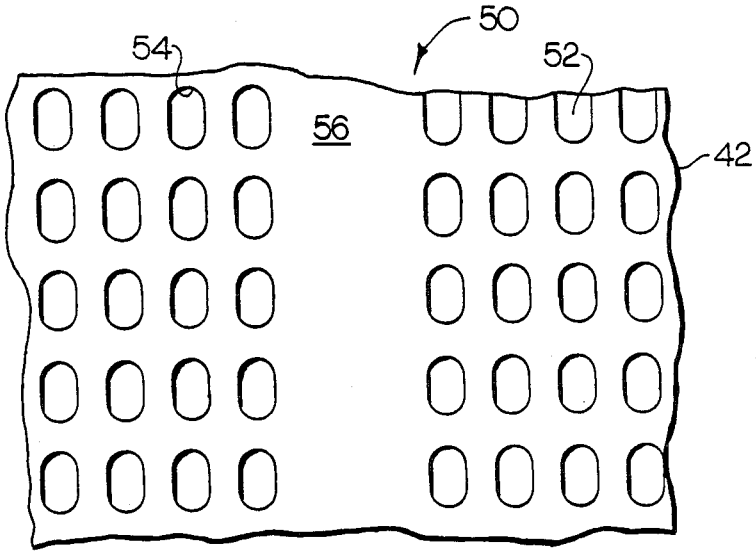
FIG. 3 is an enlarged partial side view of a portion of the assembly taken substantially along the line III—III.

As best seen in FIG. 3 and 4, a plurality of openings 50 are defined in the outer member 42. The plurality of openings 50 represent between 70% to 90% of the area of the outer member 42. A means is for forming 51 a lower inlet 60 and includes a portion of the plurality of openings 50 located near the lower port in 46 of the outer member 42. In the subject embodiment, the plurality of openings 50 are elongate openings 52 having rounded corners 54. A plurality of nonperforated portions 56 are distributed in the outer member 42 among various ones of the plurality of openings 50. The nonperforated portions 56 having the tabs 19 aligned thereto are adapted to connect the outer member 42 to the engine 14 and the exhaust manifold 16. The tabs 19 are spaced apart from one another providing a space 57. Similar tabs 19 and spaces 57 are shown in FIG. 4 and attach the inner and outer members 22,42 to the heat source 12. The tabs 19 near the lower portion are separate members but could be a part of the inner or outer member 22,42 as are the tabs 19 near the upper portion 44.

A second cooling flow path 58 is defined in the heat shield assembly 10 between the inner member 22 and the outer member 42 and as is represented by arrows "B", is adapted to convect heat away from the inner and outer members 22,42. The second cooling flow path 58 includes the lower inlet 52 located near the lower portion 46 of the outer member 42 and an upper outlet 62 located near the upper portion 44 of the outer member 42. The upper outlet 62 is defined by the openings 50 and the spaces 57 between the tabs 19. The second cooling flow path 58 defines a semi-nautilus shape 66 which includes a plurality of chambers 68. Each chamber of the plurality of chambers 68 progressively increases in area from a line of contact between the lower portion 46 of the outer member 42 with the bottom portion 24 of the inner member 22 and a line of contact of the upper portion 44 of the outer member 42 with the top portion 30 of the inner member 22. The area of each chamber 68 of the plurality of chambers 68 progressively increases with respect to the smallest chamber by a factor of approximately 10.

INDUSTRIAL APPLICABILITY

The heat shield assembly 10 is used to protect persons from being burned when coming in contact with that portion of the engine assembly. The heat shield assembly 10 can be used with any engine 14 configuration but is best suited for V-type engines 14 where the exhaust manifold 16 is horizontal and on the outside away from the center of the engine 14. Many of these V-type engines 14 have been used to replace older in-line engines 14 where the problem of being burned was not as prevalent. The engines 14 are normally oriented in a series of rows, the hot exhaust manifolds 16 bordering the walkways. To prevent a person from becoming burned, the heat shield assembly 10 of the present invention is used. The heat shield assembly is also useful on mobile equipment to protect the operator when servicing or checking engine compartment levels. The heat shield assembly 10 covers the manifold from direct oil spray in the event of an oil line leak thusly preventing combustion of the oil.

Figure 2:
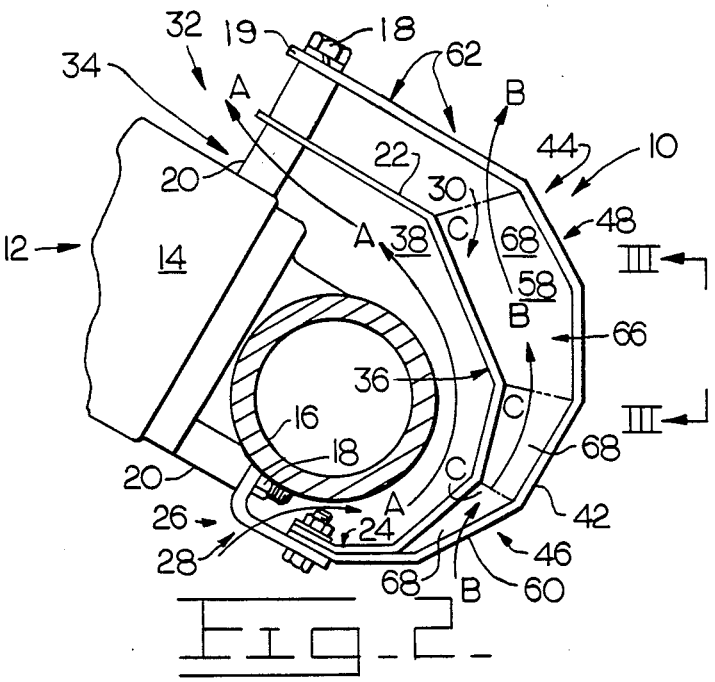
FIG. 2 is a cross section of the assembly taken substantially along the line II—II.

As the engine 14 operates, the exhaust manifold 16 becomes hot and radiates heat into the first cooling flow path 38. The inner member 22 absorbs the heat and radiates heat to both the first cooling flow path 38 and the second cooling flow path 58 during the changing temperature of the exhaust manifold caused by various loadings on the engine. As best shown in FIG. 2 by arrows A, cooler air enters at the lower inlet opening 26 of the first cooling flow path 38. Due to the configuration of the first cooling flow path 38, a chimney effect is produced. The heat shield assembly 10 is attached to the bottom of the exhaust manifold 16 and the closeness of the assembly 10 and the manifold 16 establishes a path for heat transfer from the exhaust manifold 16 to the bottom and lower portion 24,46 of the heat shield assembly 10 increasing the upward flow of air. The cool air entering the lower inlet opening 26 is drawn through the first cooling flow path 38 and exits at the upper outlet opening 32. The flow of the air through the first cooling flow path 38 draws the heat away from the exhaust manifold 16 and the inner member 22 thus effectively reducing the temperature of these components.

The second cooling flow path 58 functions in a manner similar to the first cooling flow path 38 as shown by the arrows B. The flow of air through the second cooling flow path 58 draws the heat from the inner member 22 and the outer member 42 thus effectively cooling the inner and outer members 22,42 before exiting the upper outlet opening 62. By this arrangement the temperature of the outer member 42 can be maintained, for example, below 93° C. (200° F.).

For cost efficiency and ease of manufacturing, the inner and outer members 22,42 have been bent to form a semi-nautilus shape 66 rather than formed to an elliptical shape. Experimentation has shown that the best cooling effect can be created by having the plurality of chambers 68 increase by a factor of approximately 10 from the bottom and lower portions 24,46 to the top and upper portions 30,44. Other rates of increase could be used and would function but with less efficiency without departing from the gist of the invention.

It is recognized that the plurality of perforated openings 50 could be round or any shape desirable. However, it has been found that the elongated shape with rounded corners provides the best combination of air flow characteristics and structural strength when the openings make up between 70% to 90% of the area of the outer member 42.

Although the heat shield assembly has been defined to reduce the temperature around an exhaust manifold, the heat shield assembly could function as well for other areas of an exhaust system requiring shielding such as a muffler or exhaust pipe.

Other aspects, objects and advantages of this invention can be obtained from a study of the drawings, the disclosure and the appended claims.

What is claimed is:

1. A heat shield assembly adapted for use with an exhaust system of an engine, comprising:

a heat source connected to the engine;

an inner member partially surrounding the heat source and being supported in a predetermined spaced relation thereto;

said inner member being solid and having a bottom portion spaced away from the heat source to form a lower inlet opening, a top portion spaced away from the heat source a distance greater than that of the bottom portion to form an upper outlet opening, and an intermediate portion located between the top portion and the bottom portion and spaced from the heat source a distance intermediate of the distances at the bottom portion and the top portion;

a first cooling flow path defined between the heat source and the inner member and being adapted to convect heat away from said heat source and said inner member;

an outer member having an upper portion and a lower portion and being supported in at least partially covering predetermined spaced relation to the inner member; and a second cooling flow path defined between the inner member and the outer member and being adapted to convect heat away from said inner and outer members.

2. The heat shield assembly of claim 1, wherein said lower inlet opening defines a first cross-sectional area and said upper outlet opening defines a second cross-sectional area layer than said first cross-sectional area.

3. The heat shield assembly of claim 2, wherein said first cooling flow path is adapted to pass air therethrough so that the air progressively draws heat from the heat source and the inner member as the air passes through the first cooling flow path.

4. The heat shield assembly of claim 3, wherein the inner member absorbs heat and radiates said heat into said first and second cooling flow paths.

5. The heat shield assembly of claim 1 wherein the outer member has a plurality of perforated openings therein.

6. The heat shield assembly of claim 5, wherein said outer member has an intermediate portion located between the lower portion and the upper portion, said lower portion is attached to the inner member, said outer member upper portion is spaced from the inner member at a predetermined distance, and said outer member intermediate portion is spaced from the inner member at a distance less than the distance between the upper portion and inner member.

7. The heat shield assembly of claim 6, wherein the second cooling flow path has means for forming a lower inlet near the lower portion of the outer member and an upper outlet near the upper portion of the outer member, said second cooling flow path being adapted to connectively pass air therethrough so that the air progressively draws heat from the inner and outer members as the air passes through the second cooling flow path.

8. The heat shield assembly of claim 5, wherein the plurality of perforated openings make up between 70% to 90% of the area of said outer member.

9. The heat shield assembly of claim 8, wherein each of said plurality of perforated openings is an elongate opening having rounded corners.

10. The heat shield assembly of claim 9, wherein the outer member has a plurality of nonperforated portions distributed among various ones of the plurality of perforated openings.

11. The heat shield assembly of claim 10, wherein the nonperforated portions are connected to the engine and the heat source.

12. The heat shield assembly of claim 1 wherein said heat source is a substantially horizontally disposed exhaust manifold.

13. The heat shield assembly of claim 5, wherein said second cooling flow path has a semi-nautilus shape.

14. The heat shield assembly of claim 13, wherein said semi-nautilus shape includes a plurality of chambers, each chamber of said plurality of chambers progressively increases in area from a line of contact between the lower portion of the outer member and the bottom portion of the inner member to a line of contact of the upper portion of the outer member with the top portion of said inner member.

15. The heat shield of claim 14, wherein said plurality of chambers of progressively increasing areas each increase at an additive rate by a factor of approximately 10 square units.

* * * * *